US007104020B1

(12) United States Patent
Suttle

(10) Patent No.: US 7,104,020 B1
(45) Date of Patent: Sep. 12, 2006

(54) STANDING SEAM STRUCTURAL PANEL

(76) Inventor: Terry Lynn Suttle, 20539 Longbay Dr., Yorba Linda, CA (US) 92887

( * ) Notice: Subject to any disclaimer, the term of this patent is extended or adjusted under 35 U.S.C. 154(b) by 306 days.

(21) Appl. No.: 10/772,330

(22) Filed: Feb. 6, 2004

(51) Int. Cl.
*E04D 1/34* (2006.01)

(52) U.S. Cl. ..... 52/551; 52/478; 52/506.05; 52/521; 52/537; 52/542; 52/543; 52/544; 52/588.1; 52/589.1; 52/592.1

(58) Field of Classification Search ..... 52/478, 52/520, 536, 544, 588.1, 589.1, 521, 522, 52/542, 543, 545, 551, 529, 530, 508, 748.1, 52/592.1, 506.05
See application file for complete search history.

(56) References Cited

U.S. PATENT DOCUMENTS 3,394,524 A * 7/1968 Howarth ..... 52/588.1
3,606,718 A * 9/1971 Curran ..... 52/542
4,271,653 A * 6/1981 Buchhorn ..... 52/522
4,467,582 A * 8/1984 Hague ..... 52/478
4,486,998 A * 12/1984 Hague ..... 52/478
4,918,898 A * 4/1990 McLeod, Jr. ..... 52/588.1
5,201,158 A * 4/1993 Bayley et al. ..... 52/537
5,519,974 A * 5/1996 Greenberg ..... 52/518
5,524,409 A * 6/1996 Kaiser ..... 52/588.1
5,535,567 A * 7/1996 Cahoon ..... 52/520
6,543,197 B1 * 4/2003 Wetzel et al. ..... 52/581

* cited by examiner

*Primary Examiner*—Carl D. Friedman
*Assistant Examiner*—Yvonne M. Horton
(74) *Attorney, Agent, or Firm*—G. Donald Weber, Jr.

(57) ABSTRACT

A multi-ribbed, standing seam structural roof panel with double ribs which can be attached directly to building framing to create a structural rated building panel with shear values which also serves as waterproofing panel.

20 Claims, 2 Drawing Sheets

STANDING SEAM STRUCTURAL PANEL

BACKGROUND

1. Field of the Invention

This invention is directed to a structural building panel as well as a standing seam, metal roofing product or panel, in general, and to such a panel that weather proofs the structure that it covers and also is a structural component attached to the structure and protects the attaching hardware from weather, in particular.

2. Prior Art

A standing seam roof is typically a roofing system that attaches to the structure in a non-positive way as not to create a positive bond to the building. This roof is considered to be "floating" and is not used in the calculations to determine shear values of a structure. This roof system is designed to waterproof the structure only.

Another metal roof panel is a bat and seam roof which has a cap which covers the vulnerable seam preventing moisture from entering the structure. This roof panel is another "floating" roof using a clip to hold down the panel. This system has no shear strength value. This system is designed to waterproof only.

Other roofing systems which screw through the roof panel do not have weather protection from the attaching hardware or have not been designed with a standing seam construction so as a structural panel.

In all instances, the lack of shear ratings in "floating" roof panels requires extra framing under the roof to accommodate the lack of strength and integrity that the typical metal roof does not offer.

The screw down panel systems do create a certain amount of shear value but leave the attaching hardware vulnerable to the weather and is not a standing seam roof.

It has long been desired to obtain a joint for standard (not specially preformed) roofing sheets of so-called corrugated or V-crimp type. Such sheets are used extensively as shipped from the factories in closely nested packs and carried in stock by dealers of such materials in all parts of the country. In use they are almost invariably overlapped and nailed down, the nails being driven through the high ridges (high parts of the corrugations or crimps) on the theory that water will not seek an opening at the top of such exposed ridges, but will run off into the low areas. This, however, has proven a fallacy, inasmuch as the nails are exposed and work loose whereupon water penetrates the roof. This roof is merely a sheet metal panel and is not considered a standing seam roof. Various methods have been proposed to overcome this defect, but most of them require working of the standard sheets in the field and often requires special tools which increases the insulation costs.

Other methods of panel manufacture have been advocated which require the manufacturer to make a special sheet with obvious manufacturing, distribution and application drawbacks. However, even with such special sheets, exposed nails are still involved, and the surfacing does not prevent the access of water. On these panels the attaching hardware, either screws or nails, is exposed directly to the weather.

SUMMARY OF THE INSTANT INVENTION

The subject roof panel has all the desired attributes of known panels while eliminating the undesirable characteristics thereof. The roof panel, typically metal, has double ribs in between each pan of the roofing panel. In between each double rib is the attaching hardware component, typically a screw, that will pass through the roof panel and attach directly to the roof structure underneath at appropriate distances between each screw allowing a positive connection and achieving a shear value making this roof panel a structural component. To weather proof the attaching hardware the double ribs are formed to accommodate a cover that snaps into place covering and weatherproofing the attaching hardware. The ribs are of sufficient height to allow a remarkable watershed and to add shear strength value to the structure, as well as increase the uplift and load characteristics.

This invention relates to roofing and like structures and particularly to a novel watertight joint for use with sheet roofing or other surfacing material. For example, with rigid sheets, generally of metal but may be of composition or formed plastic or other composition, and as generally used in roofing, but may be used for siding and other surfacing purposes as well.

DESCRIPTION OF A PREFERRED EMBODIMENT

Figure 1:
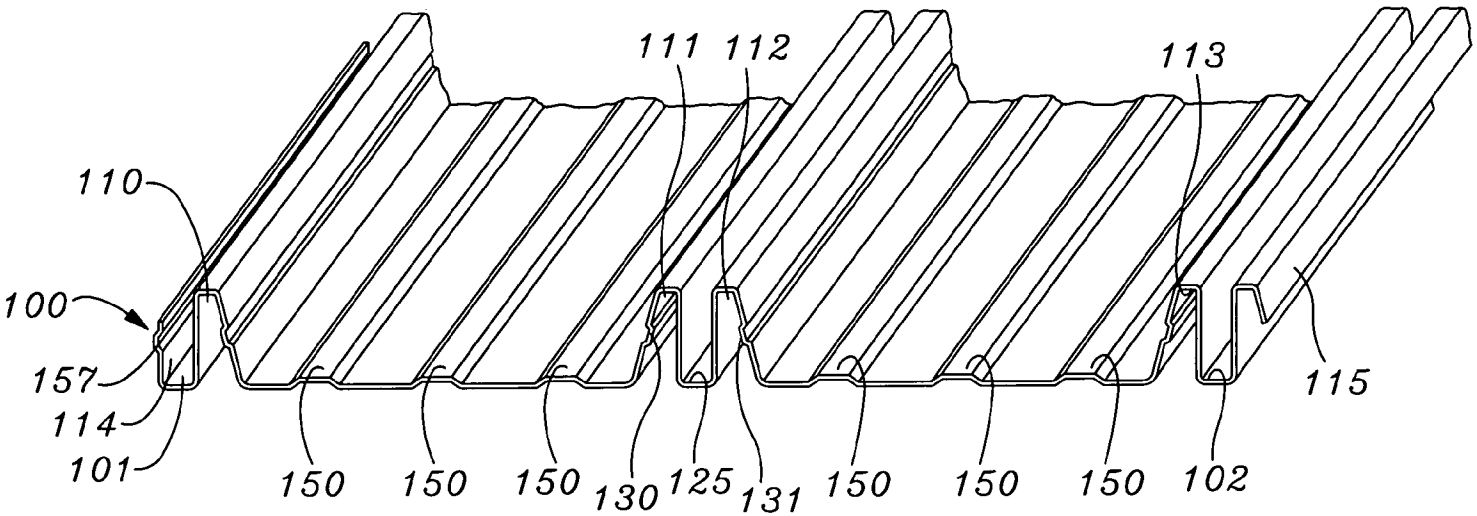
FIG. 1 is a perspective view of a portion of the panel of the instant invention.

Referring now to FIG. 1, there is shown a perspective view of a portion of the panel 100 of the instant invention. The panel 100 is, typically, fabricated of sheet metal such as aluminum, galvanized steel or other suitable material as determined by the application thereof. That is, for applications requiring substantial strength, panel is fabricated of a desirable metal. In other applications, the panel can be fabricated of appropriate types of plastic, fiberglass or the like which may include reinforcing materials or the like.

The panel 100, as shown in FIG. 1, has a nominal width of 24" which is measured from the centers of end valleys or troughs 101 and 102. Typically, the panel can be fabricated in lengths of 6', 8' or more. These dimensions are typical and are not limitative of the invention.

The panel 100 includes a plurality of upright ribs 110 111, 112 and 113 as well as a plurality of partial upright ribs 114 and 115. The partial upright ribs 114 and 115 interlock with the counterpart upright ribs 110 and 113 on adjacent panels as described infra. As will be seen, end valley (or trough) 102 of one panel 100 nestles into end valley (or trough) 101 of an adjacent panel.

A pair of upright ribs, e.g. ribs 111 and 112 are formed at the center of panel 100. These central upright ribs are formed as mirror images of each other with a narrow valley (or trough) 125 therebetween. The backs of the central ribs 111 and 112 are essentially an upright planar surface. The front of each of the ribs 111 and 112 is disposed at an angle of approximately 70° relative to the surface of the panel 100 although his angle may vary for design preference. The front surface of each upright rib 111 and 112, respectively, includes a longitudinal depression or groove 130 and 131 formed therein. The grooves provide rigidity to the panels and, as well, interlock with a protective cap as discussed infra relative to FIG. 5.

Single upright ribs 110 and 113 are formed adjacent the outer edges of a panel 100. The upright ribs 110 and 113 are identical to upright ribs 112 and 111, respectively, with a planar, upright back surface and a grooved front surface.

The partial upright ribs 114 and 115 are formed at the outer longitudinal edges of panel 100. The partial upright rib 114 is substantially similar to the lower portion of the back surface of upright ribs 111 or 113, i.e., it is a planar surface with a groove 157 therein.

Conversely, the partial upright rib 115 is substantially similar to the back and the upper portion of the front surface of upright rib 112 (without the groove 131). That is, the angled portion of rib 115 terminates just above where the dimple would be in a counterpart rib.

Troughs 126 and 127 are formed between the adjacent upright and partial upright ribs at each end of the panel. The troughs 126 and 127 are substantially similar to trough 125 in shape and dimension. (It is noted that through or valley is used to designate the same configuration in this description)

A plurality of low profile ridges or furrows 150 are formed in the panel intermediate the central upright ribs and the edge upright ribs. The ridges 150 are formed in a conventional manner and provide longitudinal strength for the panels.

In a typical (not limitative) construction, the upright ribs 110, 111, 112 and 113 are about 1¾" tall while the ridges 150 are about ⅛" tall. The partial upright rib 114 is about 11/16" tall. The trough 125 is about ¾" wide. The trough 102 is about ¾" wide and the troughs 101 are about 13/16" wide so that a trough 102 can fit into trough 101 when adjacent panels are overlapped. These dimensions are typical only and are not intended to be limitative of the scope of the invention.

Figure 2:
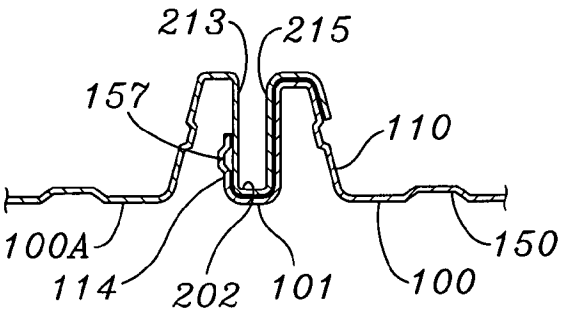
FIG. 2 is an enlarged end view of an overlapping joint between edges of two adjacent panels of the instant invention with a cap assembled thereto.

Referring now to FIG. 2, there is shown an enlarged view of the overlapping joint between edges of a pair of adjacent panels. The left edge of panel 100 includes upright rib 110, partial upright rib 114 and the intervening trough 101 as shown in FIG. 1.

The right edge of panel 100A (which is substantially identical to panel 100) includes the upright rib 213, the partial upright rib 215, and the intervening trough 202. (These components are substantially identical to the counterpart components 113, 115 and 102 shown in FIG. 1.)

It is seen that trough 202 rests fairly snugly within trough 101. Likewise, partial upright rib 215 overlies and fairly snugly engages to upper end of upright rib 110.

This interaction of the respective edges of adjacent panels 100 and 100A provides a structurally strong junction of the panels. The overlap of the edges reduces (but, typically, does not eliminate) leakage through the assemble panel structure as is discussed infra.

Figure 3:
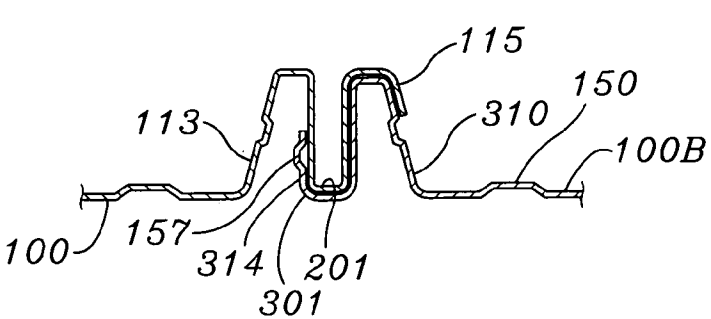
FIG. 3 is an enlarged end view of an overlapping joint of the opposite edges of two adjacent panels of the instant invention.

Referring now to FIG. 3, there is shown an enlarged view of the overlapping joint between edges of a pair of adjacent panels. The right edge of panel 100 includes upright rib 113, partial upright rib 115 and the intervening trough 102 as shown in FIG. 1.

The left edge of panel 100B (which is substantially identical to panel 100) includes the upright rib 310, the partial upright rib 314, and the intervening trough 301. (These components are substantially identical to the counterpart components 110, 114 and 101 shown in FIG. 1.)

It is seen that trough 102 rests fairly snugly within trough 301. Likewise, partial upright rib 115 overlies and fairly snugly engages to upper end of upright rib 310.

This interaction of the respective edges of adjacent panels 100 and 100B provides a structurally strong junction of the panels. The overlap of the edges reduces (but, typically, does not eliminate) leakage through the assemble panel structure as is discussed infra.

Figure 4:
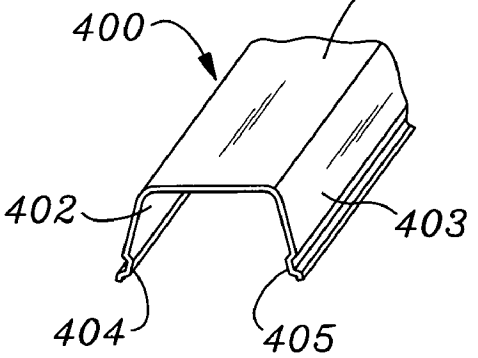
FIG. 4 is a perspective view of a sealing cap of the instant invention.

Referring now to FIG. 4, there is shown a perspective view of a sealing cap 400 of the instant invention. The cap 400 is, typically, fabricated of the same material as the panel 100 (as well as panels 100A and 100B) although other alternative materials are contemplated within the scope of the invention. The caps 400 are, typically, fabricated in the same lengths as the panels 100 for convenience.

The caps 400 are substantially inverted U-shaped troughs with a flat, planar upper surface 401. (It is contemplated that the upper surface 401 can be curvilinear or any other geometrical configuration, if so desired.)

The sides 402 and 403 extend downwardly from the upper surface 401. In a preferred embodiment, the sides 402 and 403 are formed at an angle relative to the upper surface 401 in order to conform to and securely engage with the angled surfaces of adjacent pairs of upright ribs 110, 111, 112, and 115 (and mating partial upright ribs) as described supra).

The sides 402 and 403 of the cap include elongated folds or lips 404 and 405, respectively. These lips are formed to engage the grooves 130 and 131 in upright ribs 111 and 112 (and counterpart grooves in the other upright ribs) as described supra.

Figure 5:
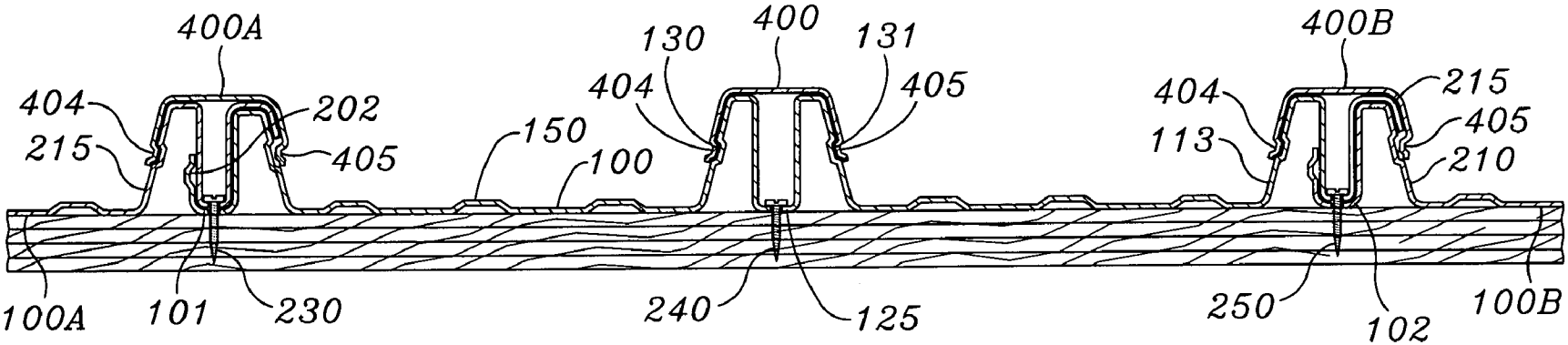
FIG. 5 is an edge view of a panel assembly with caps assembled thereto.

Referring now to FIG. 5, there is shown an edge view of a plurality of panels 100, 100A and 100B assembled in the operative fashion with the adjunct caps 400, 400A and 400B mounted thereon. The trough 202 of panel 100A (equivalent to trough 102 in FIG. 1) nestles into trough 101 of panel 100. The partial upright rib 215 of panel 100A overlaps and engages the upper portion of upright ridge 110 of panel 100 to form an overlapping joint or junction of the panels as described relative to FIG. 2.

Likewise, the partial upright rib 215 of panel 100 overlaps and engages the upright rib 210 of panel 100B to form a lip junction therewith as described relative to FIG. 3.

Appropriate screws 230, 240 and 250 are installed in the troughs 101, 125, and 102 through the material of the panel (or panels) into the support structure, such as a roof, a joist or the like. A suitable sealant or grommet ring may be placed on each screw to enhance water leakage resistance.

After the screws 230, 240 and 250 are mounted to the structure to provide water proofing protection and securement for the roof.

As discussed supra, the caps 400, 400A and 400B fairly snugly engage the upper ends of a pair of adjacent upright ribs. The slightly angled sides of the caps engage the surfaces of the upright ribs through a "spring-biased" friction fit.

In addition, the lips 404 and 405 (and counterparts) engage the grooves 130 and 131 (and counterparts) in the upright ribs thereby providing a secure interconnection between the panels and the sealing caps.

In addition to providing a secure, water leakage proof structure, the instant invention provides additional structural strength including substantial shear values. Thus, in addition to providing a "standing seam" roofing product, the panel assembly is a structural building panel which demonstrates load bearing capabilities to reduce certain cumbersome framing requirements.

Thus, there is shown and described a unique design and concept of a standing seam structural panel. While this description is directed to particular embodiments, it is understood that those skilled in the art may conceive modifications and/or variations to the specific embodiments shown and described herein. Any such modifications or variations which within the purview of this description are intended to be included, therein as well. It is understood that the description herein is intended to be illustrative only and is not intended to be limitative. Rather, the scope of the invention described herein is limited only by the claims appended hereto.

The invention claimed is:

1. A structural panel comprising, a sheet of material, a plurality of upright ribs formed in said sheet of material which extend upwardly from the surface of said sheet, a plurality of partial upright ribs formed in said sheet of material which extend upwardly from the surface of said sheet, each of said upright ribs includes a first surface of the rib which is normal to the surface of said sheet and a second surface of the rib which is disposed at an angle to said first surface of the rib, and a sealing cap which is adapted to engage a pair of adjacent upright ribs.

2. The structural panel recited in claim 1 wherein, at least two of said upright ribs are disposed adjacent to each other.

3. The structural panel recited in claim 1 wherein, at least one of said upright ribs and at least one of said partial upright ribs are disposed adjacent to each other and adjacent to an edge of said sheet.

4. The structural panel recited in claim 1 wherein, a pair of said upright ribs is formed on said sheet with the first surfaces adjacent to each other to form a trough therebetween.

5. The structural panel recited in claim 1 wherein, each of said partial upright ribs includes a first surface which is normal to the surface of said sheet.

6. The structural panel recited in claim 5 wherein, a partial upright rib and an upright rib are formed in said sheet with the first surfaces adjacent to each other to form a trough therebetween.

7. The structural panel recited in claim 1 wherein, said sealing cap is a generally inverted U-shaped member which selectively engages a pair of upright ribs.

8. The structural panel recited in claim 1 wherein, said upright ribs and said partial upright ribs are integrally formed in parallel to each other in said sheet of material.

9. The structural panel recited in claim 1 wherein, said sheet of material is substantially waterproof.

10. The structural panel recited in claim 1 wherein, each of said upright ribs includes at least one groove formed in said second surface substantially parallel to the surface of said sheet.

11. The structural panel recited in claim 10 wherein, said sealing cap includes a lip at each edge thereof to engage the groove in said upright ribs.

12. The structural panel recited in claim 3 wherein, the upright rib and the partial upright rib disposed adjacent to each other and adjacent to an edge of said sheet are adapted to overlie and engage the upright rib and the partial upright rib disposed adjacent to each other and adjacent to an edge of a second substantially identical structural panel.

13. The structural panel recited in claim 1 wherein, the angle between said second surface and said first surface is approximately 15°.

14. The structural panel recited in claim 1 wherein, a plurality of low profile ridges formed in said sheet of material to provide longitudinal strength for the panel.

15. The structural panel recited in claim 7 wherein, each of said pair of upright ribs forms a trough therebetween which trough is covered by said sealing cap.

16. The structural panel recited in claim 15 wherein, said trough is adapted to selectively receive fasteners for fastening said structural panel to an underlying surface.

17. The structural panel recited in claim 2 wherein, said at least two upright ribs which are disposed adjacent to each other are located adjacent a mid-portion of said sheet of material.

18. The structural panel recited in claim 1 wherein, at least one of said partial upright ribs is formed at an edge of said sheet.

19. The structural panel recited in claim 1 wherein, each of said partial upright ribs includes a first surface which is normal to the surface of said sheet and substantially parallel to said first surface of an adjacent upright rib.

20. A structural panel comprising, a sheet of material, a plurality of upright ribs formed in said sheet of material which extend upwardly from the surface of said sheet, each of said upright ribs includes a first surface of the rib which is normal to the surface of said sheet and a second surface of the rib which is disposed at an angle to said first surface of the rib, each of said upright ribs includes at least one groove formed in said second surface substantially parallel to the surface of said sheet, at least two of said upright ribs are disposed adjacent to each other and located adjacent a mid-portion of said sheet of material, a plurality of partial upright ribs formed in said sheet of material which extend upwardly from the surface of said sheet, each of said partial upright ribs includes a first surface which is normal to the surface of said sheet and substantially parallel to said first surface of an adjacent upright rib, at least one of said upright ribs and at least one of said partial upright ribs are disposed adjacent to each other and adjacent to an edge of said sheet, a partial upright rib and an upright rib are formed in said sheet with the first surfaces adjacent to each other to form a trough therebetween, at least one of said upright ribs and at least one of said partial upright ribs are disposed adjacent to each other and adjacent to an edge of said sheet, a partial upright rib and an upright rib are formed in said sheet with the respective first surfaces thereof adjacent to each other to form a trough therebetween, a sealing cap which is adapted to engage a pair of adjacent upright ribs, said sealing cap includes a lip at each edge thereof to engage the groove in each of said paid of adjacent upright ribs, and a plurality of low profile ridges formed in said sheet of material to provide longitudinal strength for the panel.

* * * * *